US005478298A

United States Patent [19]

Chen

[11] Patent Number: 5,478,298

[45] Date of Patent: Dec. 26, 1995

[54] CONVERTIBLE HORSE-RIDING TYPE EXERCISER

[76] Inventor: Paul Chen, No. 3-6, Ching Yang Road, Liu Pao Village, Ta Ya Hsiang, Taichung Hsien, Taiwan

[21] Appl. No.: 394,784

[22] Filed: Feb. 27, 1995

[51] Int. Cl.[6] ..... A63B 69/06

[52] U.S. Cl. ..... 482/95; 482/72; 482/57

[58] Field of Search ..... 482/148, 111, 482/96, 51, 95, 72, 71, 57; 472/110, 106; 280/1.182, 1.83, 1.192, 1.203, 1.204

[56] References Cited

U.S. PATENT DOCUMENTS

| | | | |
|---|---|---|---|
| 2,642,288 | 6/1953 | Bell | 482/94 |
| 4,300,760 | 11/1981 | Bobroff | 482/95 |
| 4,641,833 | 2/1987 | Trethoway | 482/72 |
| 5,156,650 | 10/1992 | Bals | 482/57 |
| 5,299,997 | 4/1994 | Chen | 482/96 |
| 5,342,269 | 8/1994 | Huang et al. | 482/95 |
| 5,366,482 | 11/1994 | Liao | 482/96 |
| 5,421,795 | 6/1995 | Chen | 482/96 |

FOREIGN PATENT DOCUMENTS

| | | | |
|---|---|---|---|
| 9218204 | of 0000 | WIPO | 482/95 |

*Primary Examiner*—Stephen R. Crow
*Assistant Examiner*—Jerome Donnelly
*Attorney, Agent, or Firm*—Charles E. Baxley

[57] ABSTRACT

An exerciser for conducting both pull type and push type exercises includes a base having a front pivot axle and a middle pivot shaft. A handle includes a middle portion pivotally coupled to the pivot axle. A post includes a lower portion pivotally coupled to the pivot shaft and includes two pivot joints located above and below the pivot shaft respectively. A link includes one end end pivotally coupled to the handle and the other end pivotally coupled to either of the pivot joints so as to simulate both pull type and push type horse riding exercises.

1 Claim, 4 Drawing Sheets

CONVERTIBLE HORSE-RIDING TYPE EXERCISER

BACKGROUND OF THE INVENTION

1. Field of the Invention

The present invention relates to an exerciser, and more particularly to a convertible horse-riding type exerciser.

2. Description of the Prior Art

Various kinds of horse riding type exercisers have been developed. Four prior arts are disclosed in U.S. Pat. No. 5,342,269 to Huang et al. issued Aug. 30, 1994; U.S. Pat. No. 5,356,357 to Wang et al. issued Oct. 18, 1994; U.S. Pat. No. 5,356,358 to Chen issued Oct. 18, 1994; and U.S. Pat. No. 5,366,428 to Liao issued Nov. 22, 1994.

However, the typical horse riding type exercisers are pull type exercisers, i.e., the handle bar may be pulled for conducting horse riding type exercises. The exercisers may not be used for conducting push type exercisers.

The present invention has arisen to mitigate and/or obviate the afore-described disadvantages of the conventional horse riding type exercisers.

SUMMARY OF THE INVENTION

The primary objective of the present invention is to provide a convertible horse-riding type exerciser which can be used for conducting both pull type and push type horse riding exercises.

In accordance with one aspect of the invention, there is provided a horse riding type exerciser comprising a base including a front portion having a pivot axle provided thereon and including a middle portion having a pivot shaft provided thereon, handle means including a middle portion pivotally coupled to the pivot axle and including a lower portion having foot support means secured thereto, post means including a lower portion pivotally coupled to the pivot shaft and including an upper portion having seat means provided thereon, the post means including a first pivot joint provided above the pivot shaft and including a second pivot joint provided below the pivot shaft, and link means including a first end pivotally coupled to the lower portion of the handle means and including a second end pivotally coupled to either of the pivot joints. The post is caused to rotate counterclockwise when the second end of the link means is pivotally coupled to the first pivot joint and when the handle means is pulled toward the seat means so as to simulate pull type horse riding exercises, and the post is caused to rotate counterclockwise when the second end of the link means is pivotally coupled to the second pivot joint and when the handle means is pushed away from the seat means so as to simulate push type horse riding exercises.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
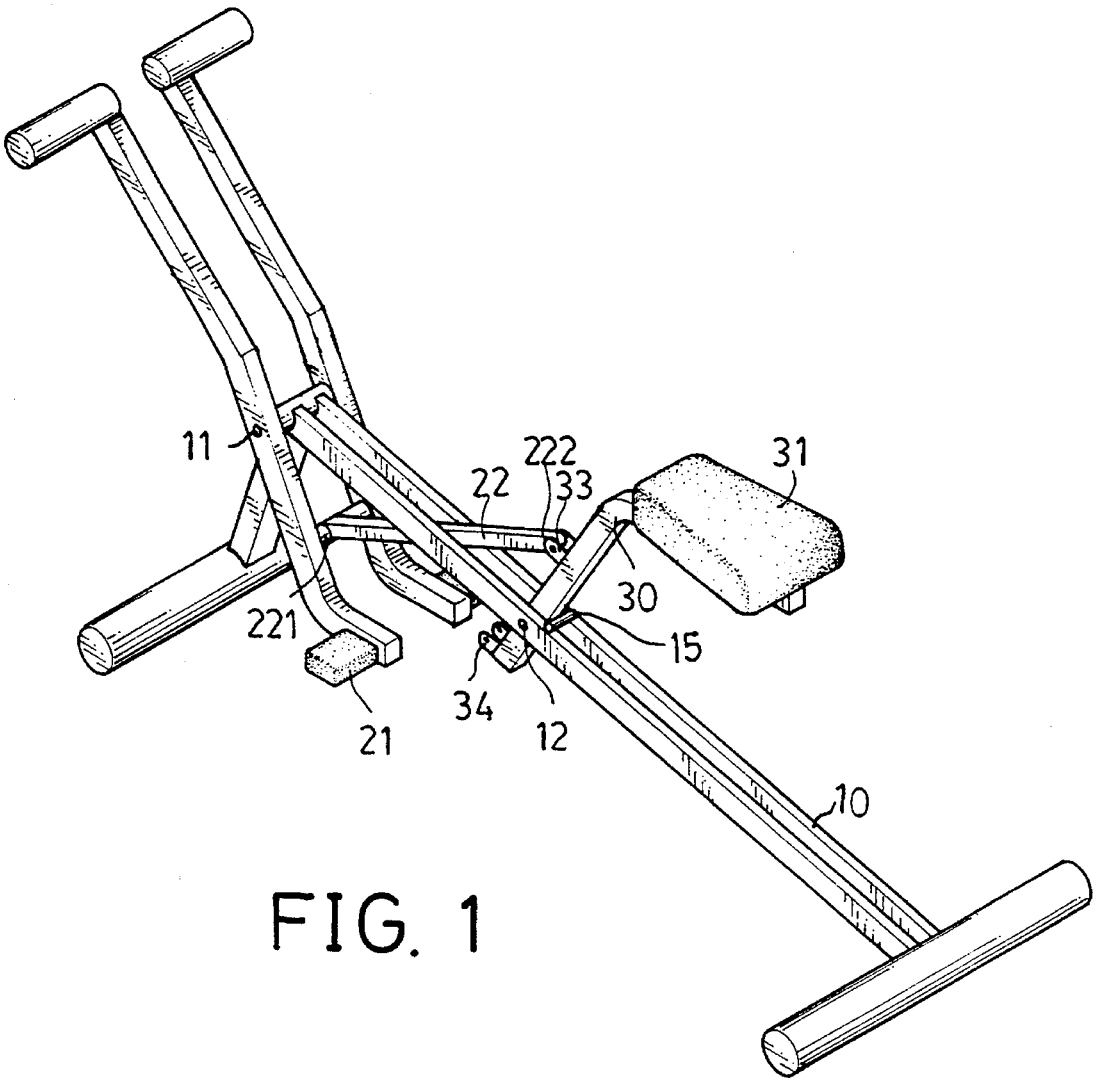
FIG. 1 is a perspective view of a horse-riding type exerciser in accordance with the present invention.
Figure 2:
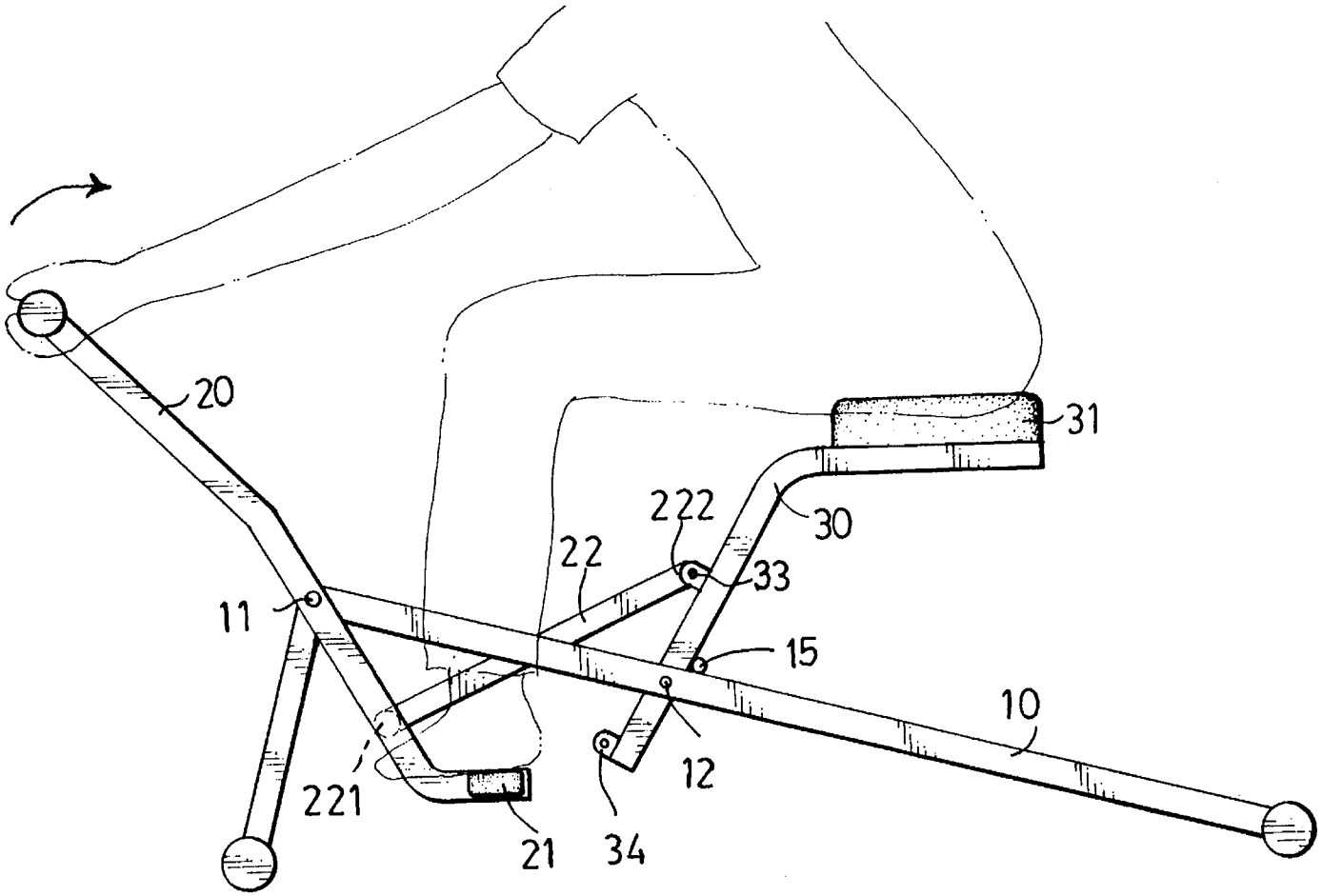
FIGS. 2, 3 and 4 are plane views illustrating the operation of the convertible horse-riding type exerciser.

Referring to the drawings, and initially to FIGS. 1 and 2, a convertible horse-riding type exerciser in accordance with the present invention may be used for conducting both pull type and push type horse riding exercises. The exerciser comprises a base 10 including a pivot axle 11 laterally provided in the front and upper portion thereof and a pivot shaft 12 laterally provided in the middle portion thereof. A pair of handles 20 include a middle portion pivotally coupled to the pivot axle 11 and include a bottom portion having foot supports 21 secured thereto. A post 30 includes a lower portion pivotally coupled to the pivot shaft 12 and includes an upper end having a seat cushion 31 secured thereto. The post 30 includes an upper pivot joint 33 provided above the pivot shaft 12 and a lower pivot joint 34 provided below the pivot shaft 12. A link 22 includes one end 221 pivotally coupled to the lower portion of the handles 20 and includes the other end 222 pivotally coupled to either of the pivot joints 33, 34 by pivot pin members.

Figure 3:
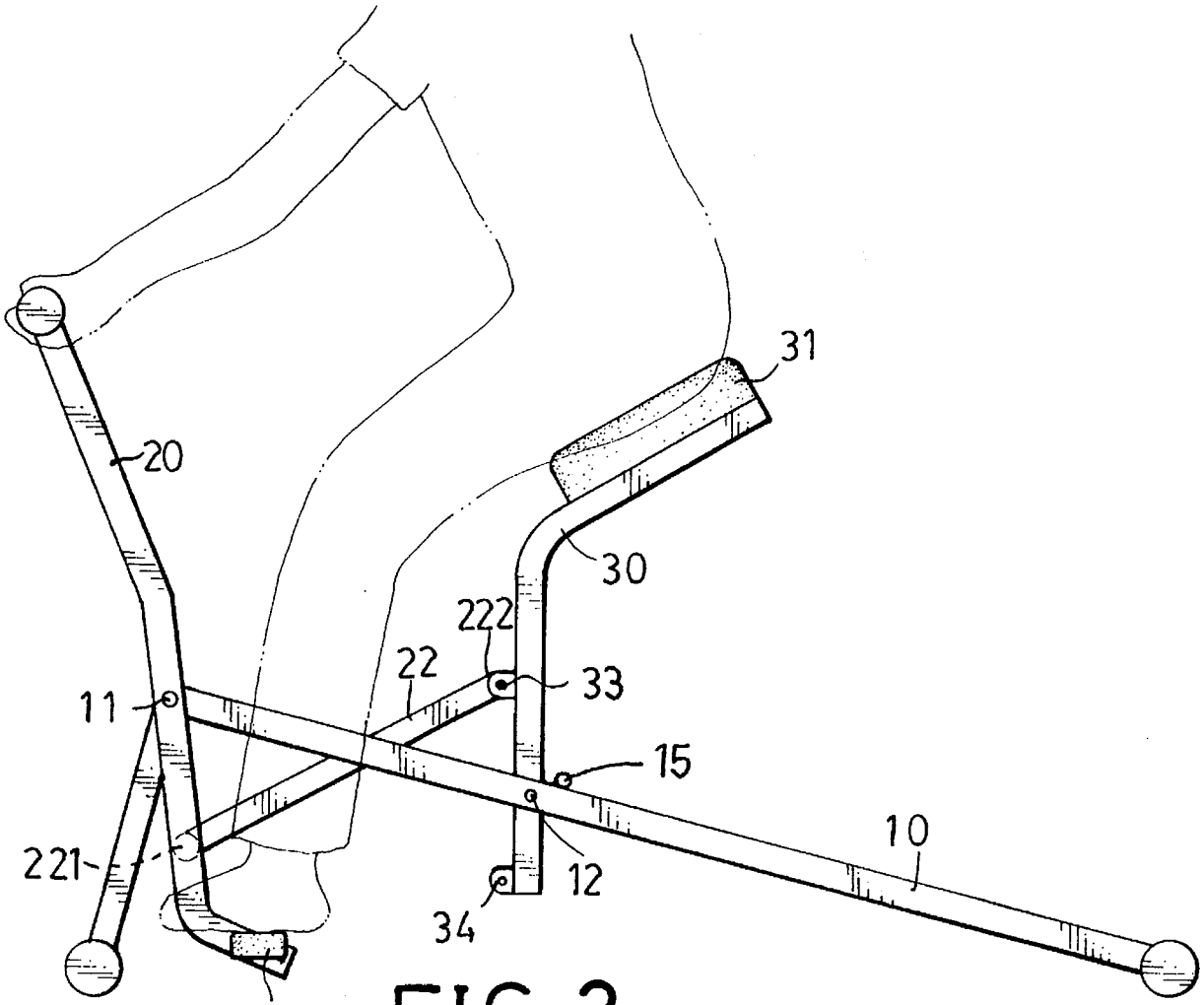

In operation, as shown in FIGS. 2 and 3, the other end 222 of the link 22 is pivotally coupled to the pivot joint 33 which is located above the pivot shaft 12. At this moment, the exerciser may be used for conducting pull type horse riding exercises. As shown in FIG. 2, when the handles 20 are pulled by the users and/or when the foot supports 21 are forced or stepped by the feet of the users, the post 30 may be rotated counterclockwise by the link 22 against the weight of the users such that the users may be caused to move upward for simulating pull type horse-riding action, as shown in FIG. 3. When the force applied to the handles 20 and/or the foot supports 21 is released, the seat cushion 31 may move downward to the position as shown in FIG. 2 again.

Figure 4:
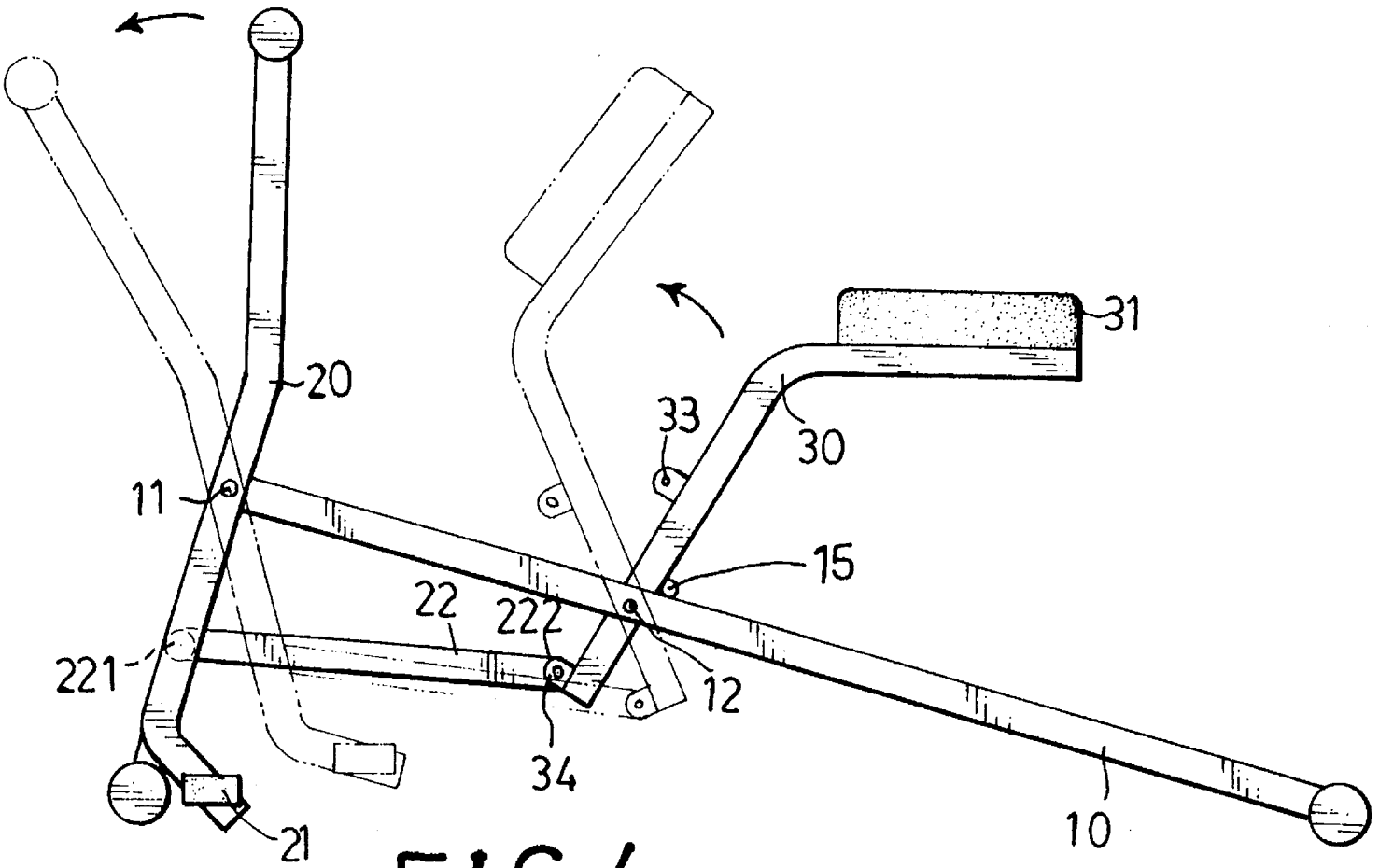

As shown in FIG. 4, the other end 222 of the link 22 is pivotally coupled to the other pivot joint 34 which is located below the pivot shaft 12. At this moment, the exerciser may be used for conducting push type horse riding exercises. When the handles 20 are pushed by the users, the post 30 may be rotated counterclockwise by the link 22 against the weight of the users such that the users may be caused to move upward for simulating push type horse-riding action. When the force applied to the handles 20 is released, the users may move downward to the rest position.

As shown in the drawings, a stop means 15 is provided on the base 10 for engaging with the post 30 so as to support the post 30 in the "downward" position or the "rest" position as shown in FIGS. 1 and 2.

Accordingly, the convertible horse-riding exerciser in accordance with the present invention can be used for conducting both pull type and push type horse riding exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding type exerciser comprising:

a base including a front portion having a pivot axle provided thereon and including a middle portion having a pivot shaft provided thereon, handle means including a middle portion pivotally coupled to said pivot axle and including a lower portion having foot support means secured thereto, post means including a lower portion pivotally coupled to said pivot shaft and including an upper portion having seat means provided thereon, said post means including a first pivot joint provided above said pivot shaft and including a second pivot joint provided below said pivot shaft, and link means including a first end pivotally coupled to said lower portion of said handle means and including a second end pivotally coupled/to either of said pivot joints, said post being caused to rotate about said pivot shaft when said second end of said link means is pivotally coupled to said first pivot joint and when said handle means is pulled toward said seat means so as to simulate pull type horse riding exercises, and said post being caused to rotate about said pivot shaft when said second end of said link means is pivotally coupled to said second pivot joint and when said handle means is pushed away from said seat means so as to simulate push type horse riding exercises.

* * * * *